United States Patent [19]

Naoomi et al.

[11] Patent Number: 5,060,495

[45] Date of Patent: Oct. 29, 1991

[54] PRESS BRAKE HAVING PLURAL PROBE PAIRS FOR MEASURING BEND ANGLES OF WORKPIECE

[75] Inventors: Miyagawa Naoomi, Gifu; Chiyoaki Yoshida, Aichi; Kazuyuki Toda, Aichi; Yukiyasu Nakamura, Aichi, all of Japan

[73] Assignee: Yamazaki Mazak Kabushiki Kaisha, Aichi, Japan

[21] Appl. No.: 554,758

[22] Filed: Jul. 16, 1990

Related U.S. Application Data

[62] Division of Ser. No. 378,622, Jun. 12, 1989.

[30] Foreign Application Priority Data

Jul. 19, 1988 [JP] Japan ..... 63-179398
Nov. 22, 1988 [JP] Japan ..... 63-294947

[51] Int. Cl.[5] ..... B21D 5/02

[52] U.S. Cl. ..... 72/10; 72/31; 72/34; 72/389

[58] Field of Search ..... 72/10, 11, 22, 389, 72/31, 702, 34

[56] References Cited

U.S. PATENT DOCUMENTS 4,864 509 9/1989 Somerville et al. ..... 72/389

FOREIGN PATENT DOCUMENTS 267018 11/1987 Japan ..... 72/389

*Primary Examiner*—David Jones
*Attorney, Agent, or Firm*—Wenderoth, Lind & Ponack

[57] ABSTRACT

The bending of a workpiece between a lower and an upper die is measured by way of a workpiece measuring device having a workpiece measuring portion. A depth chasing quantity in a predetermined position of the workpiece is obtained by a folding form operating portion on the basis of the measured folding angle. And, crowning quantity is obtained by a crowning correction operating portion. Moreover, a depth correction value is obtained by a depth correction operating portion and a balance correction value of right and left is obtained by a balance correction operating portion. Then, bending is performed on a workpiece on the basis of the obtained correction values.

1 Claim, 12 Drawing Sheets

PRESS BRAKE HAVING PLURAL PROBE PAIRS FOR MEASURING BEND ANGLES OF WORKPIECE

This application is a division of application Ser. No. 07/378,622, filed July 12, 1989.

BACKGROUND OF THE INVENTION

This invention relates to a press brake capable of measuring a bent form, such as a bent angle and bending radius without ejecting a workpiece on which bending is performed and efficiently correcting the bending angle of a workpiece on the basis of the measurement without any hand operation, and further relates to the workpiece measuring method.

In a case where a workpiece is bent in a V-form or an arc-form in a press brake, a predetermined bending is performed by inserting a workpiece between lower and upper dies. It is then measured whether the bent form of the machined workpiece, such as the bending angle and bending radius, is a set value or not. On this occasion, when the bent form is measured in a state with the machined workpiece in a press brake, it is impossible to measure correctly due to the presence of the lower die and the like. Therefore, the bent form is measured by ejecting the machined workpiece from between the upper and lower dies of a press brake in a conventional method. In a case where the measured bent form is different from a set value, remachining is performed on the workpiece by replacing it in the press brake to vary the form. In this way, correction is performed so that the measured value can be a set value. However, it is necessary to eject the workpiece from the press brake for every measurement of the bent form of the workpiece in this method. This causes reduction of machining efficiency. Besides, correction operations for remachining depend heavily on the experience of the worker. Therefore, in a case where a worker isn't skilled, it is difficult to decide the proper amount of correction quickly. Thus, the operations require much labor and time.

SUMMARY OF THE INVENTION

The primary object of the present invention is to provide a press brake capable of measuring a bent form, such as a bending angle, without ejecting from the press brake a workpiece on which bending is performed, and the workpiece measuring method.

A second object of the present invention is to provide a press brake capable of efficiently correcting the bending angle of a workpiece on which bending is performed without manual operation.

According to the present invention, the press brake comprises a lower die, an upper die movable and drivable toward the lower die, at least one workpiece measuring portion, such as a measurement clearance in said lower die, and at least one workpiece measuring means, such as a workpiece measuring unit provided in a shape corresponding to the shape of said workpiece measuring portion. It is possible to measure the bent form of a workpiece inserted between a lower and an upper die, such as a bending angle and bending radius by means of a workpiece measuring means via the workpiece measuring portion. As a result, the measurement of the bent form can be performed without ejecting the workpiece from the press brake. Thus, the machining can be efficiently performed.

In a case where a workpiece measuring means comprises a workpiece detecting means, such as a probe portion and a bent form operating portion, the bent form of a workpiece is detected by the workpiece detecting means via a workpiece measuring portion and a signal corresponding to the detected value is outputted to a bent form operation portion. Then the bent form of the workpiece can be obtained by a bent form operating portion on the basis of the signal. And in a case where a workpiece measuring means is provided which is movable in the installation direction of the lower die (for example, in the directions as shown by arrows A and B in FIG. 3), a workpiece measuring means is inserted into a desired workpiece measuring portion by properly moving the workpiece measuring means. In this state, the bent form of a workpiece can be measured Moreover, when a notched portion is formed in a lower die, the workpiece measuring operations of a workpiece measuring means can be smoothly performed via a workpiece measuring portion because the notched portion broadens the area of the workpiece measuring portion.

Moreover, a press brake equipped with a workpiece measuring means according to this invention comprises a lower die, an upper die movable and drivable toward the lower one, at least one workpiece measuring portion in said lower die and at least one workpiece measuring means provided in the shape corresponding to said workpiece measuring portion. In a case of machining of a workpiece by using the above-described press brake, a predetermined machining is performed by inserting a workpiece to be machined between said lower and upper dies. Thereafter, the bent form of the workpiece is measured by said workpiece measuring means with said workpiece inserted between said lower and upper dies. Therefore, it is possible to measure the bent form by means of the workpiece measuring means via the workpiece measuring portion without ejecting the bent workpiece from the press brake.

Moreover, the press brake according to this invention comprises a bending angle measuring unit for measuring the bent shape of a workpiece, such as the bending angle, a bent form operating portion capable of obtaining depth chasing quantity of a workpiece in a predetermined position on the basis of the bent angle determined by using said bending angle measuring unit, a crowning correction operating portion for obtaining a crowning quantity of the lower die and a depth correction operating portion for obtaining a depth correction value of the upper die on the basis of the depth chasing quantity achieved in said bent form operating portion and a balance correction operating portion for obtaining balance correction value of the right and left parts of the upper die on the basis of the depth correction value achieved in said depth correction operating portion. Accordingly, the bent angle of a workpiece after bending is measured by a bending angle measuring unit and correction can be performed by using a crowning correction operating portion, a depth correction operating portion and a balance correction operating portion in order that the depth chasing quantity obtained on the basis of the measured bent angle will be zero. As a result, the bent angle of a workpiece after bending can be automatically corrected without any hand operation.

DESCRIPTION OF THE PREFERRED EMBODIMENTS

Figure 1:
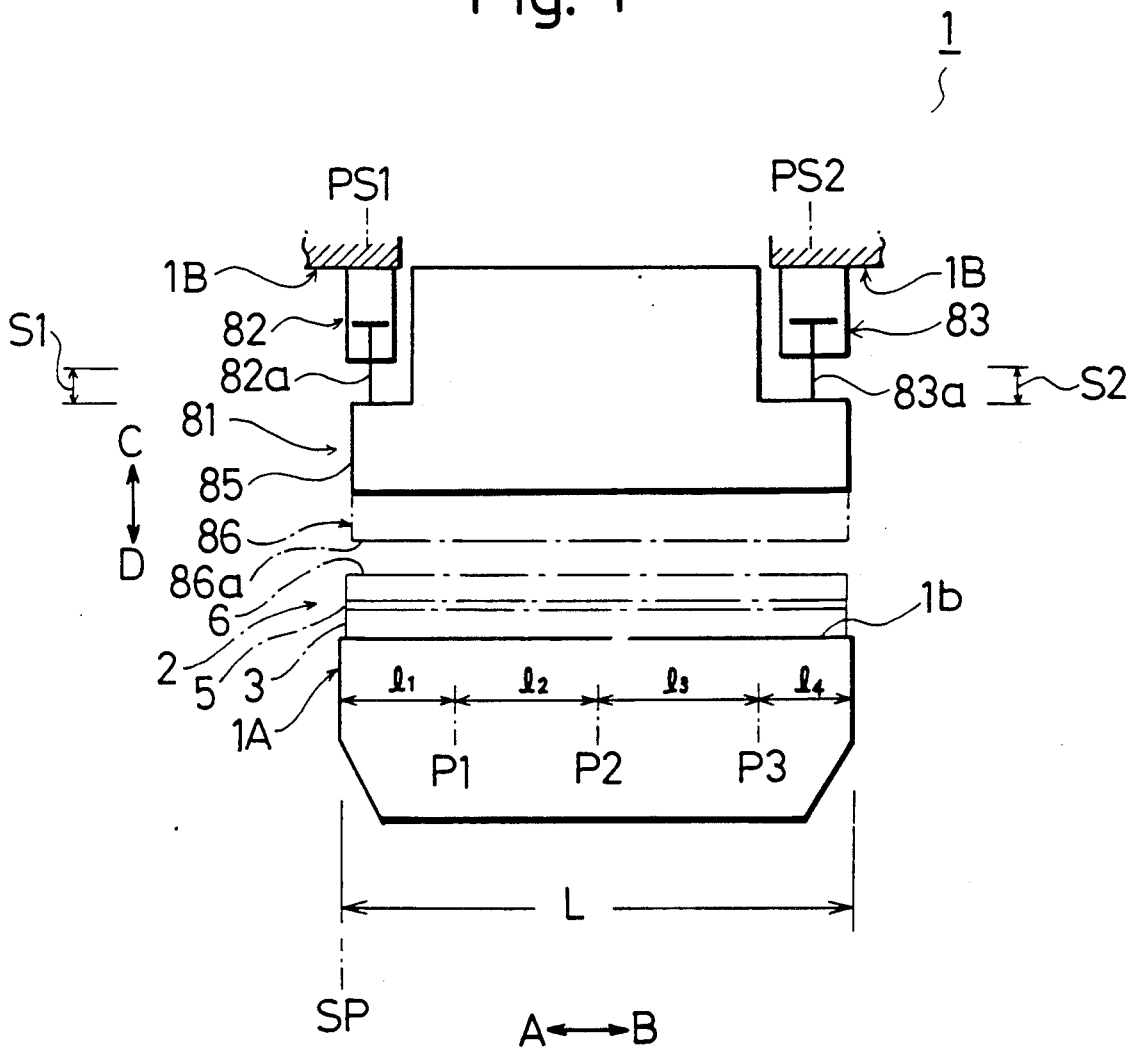
FIG. 1 is an elevation view showing an important portion of a press brake according to the present invention.
Figure 2:
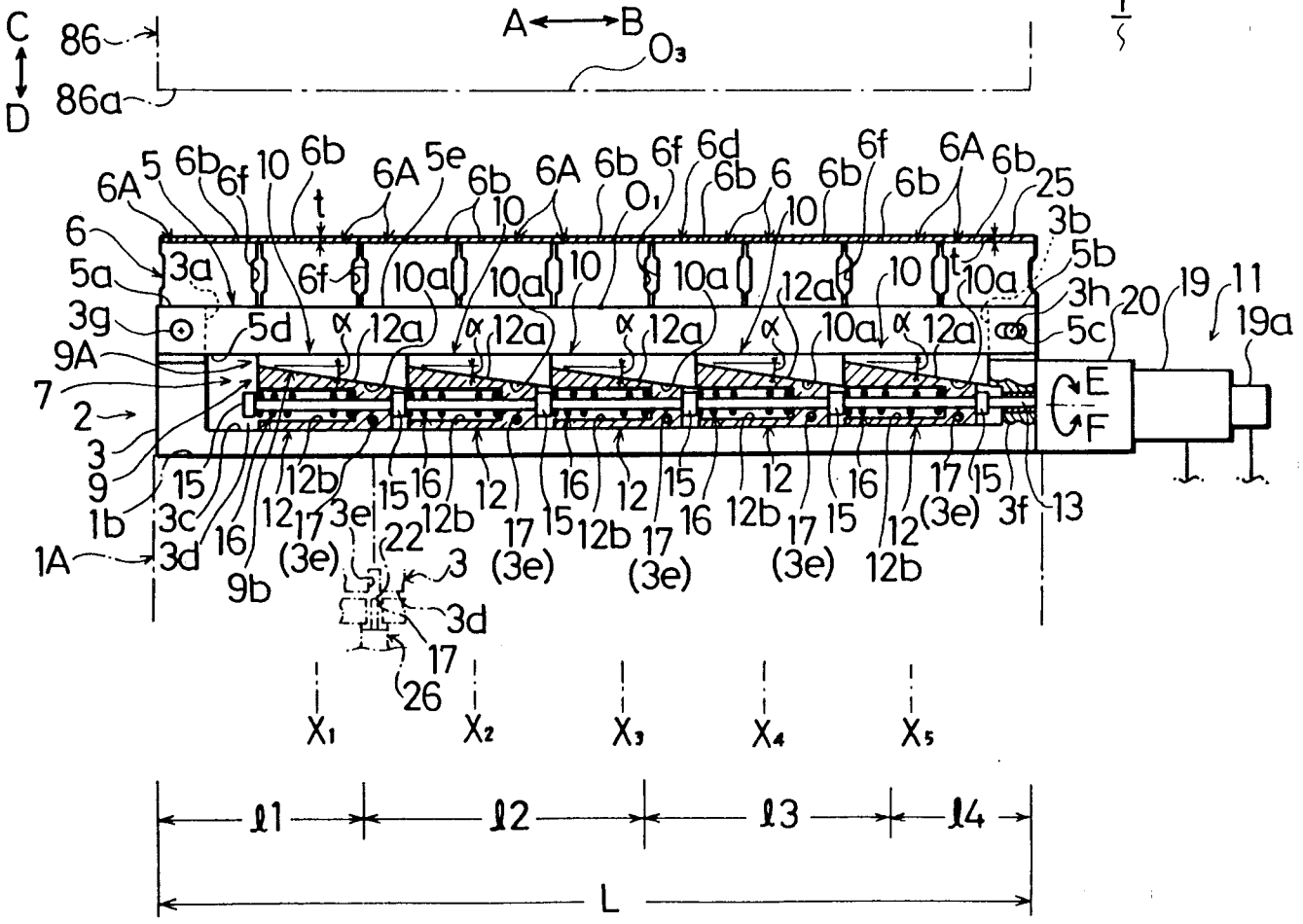
FIG. 2 is a sectional view showing an example of a lower mold portion of the press brake as shown in FIG. 1.

A press brake has a lower frame 1A as shown in FIG. 1. An installation face 1*b* is formed on the upper portion of the lower frame 1A. A lower mold portion 2 is installed on the installation face 1*b*. The lower mold portion 2 comprises a main body 3, a lower die supporting member 5, and a lower die 6 as shown in FIG. 2. On the installation face 1*b* as shown in FIG. 2, the main body 3 is provided with a surface extending in a horizontal direction (in the directions shown by arrows A and B). At the right and left end portions of the main body 3 in the figure, die supporting portions 3*a*, 3*b* are formed facing each other.

The lower die supporting member 5 is installed between the die supporting portions 3*a*, 3*b* of the main body 3 as shown in FIG. 2. The left edge portion 5*a* of the lower die supporting member 5 is rotatably mounted on the die supporting portion 3*a* on a supporting pin 3*g* or the like. An elongated hole 5*c* is provided in the right edge portion 5*b* of the lower die supporting member 5 and the direction of elongation is parallel to the directions shown by arrows A and B. A supporting pin 3*h* provided on the die supporting portion 3*b* is slidably engaged in the hole 5*c*. Moreover, a supporting recess 5*f* is provided in the upper side face 5*e* of the lower die supporting member 5 extending in the directions shown by arrows A and B in FIG. 3. The lower die 6 comprises plural unit lower dies 6A which are placed in the supporting recess 5*f* at predetermined intervals L2.

Figure 4:
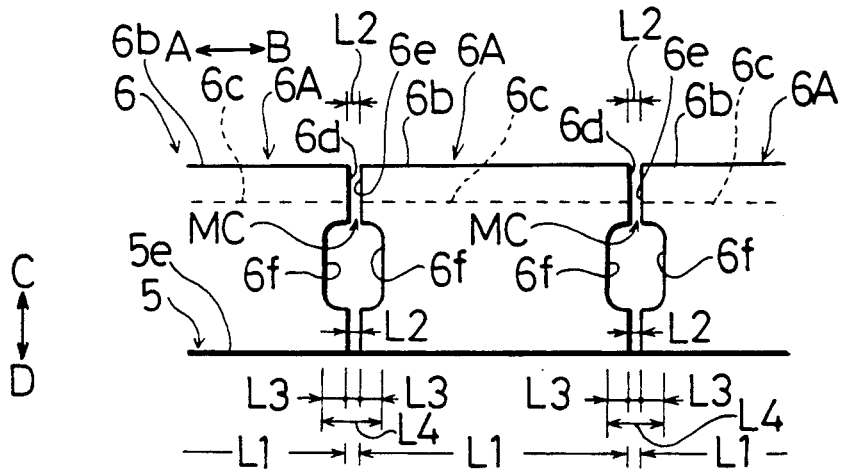
FIG. 4 is a partial elevation view showing an example of a lower die of a lower mold portion as shown in FIG. 2.
Figure 6:
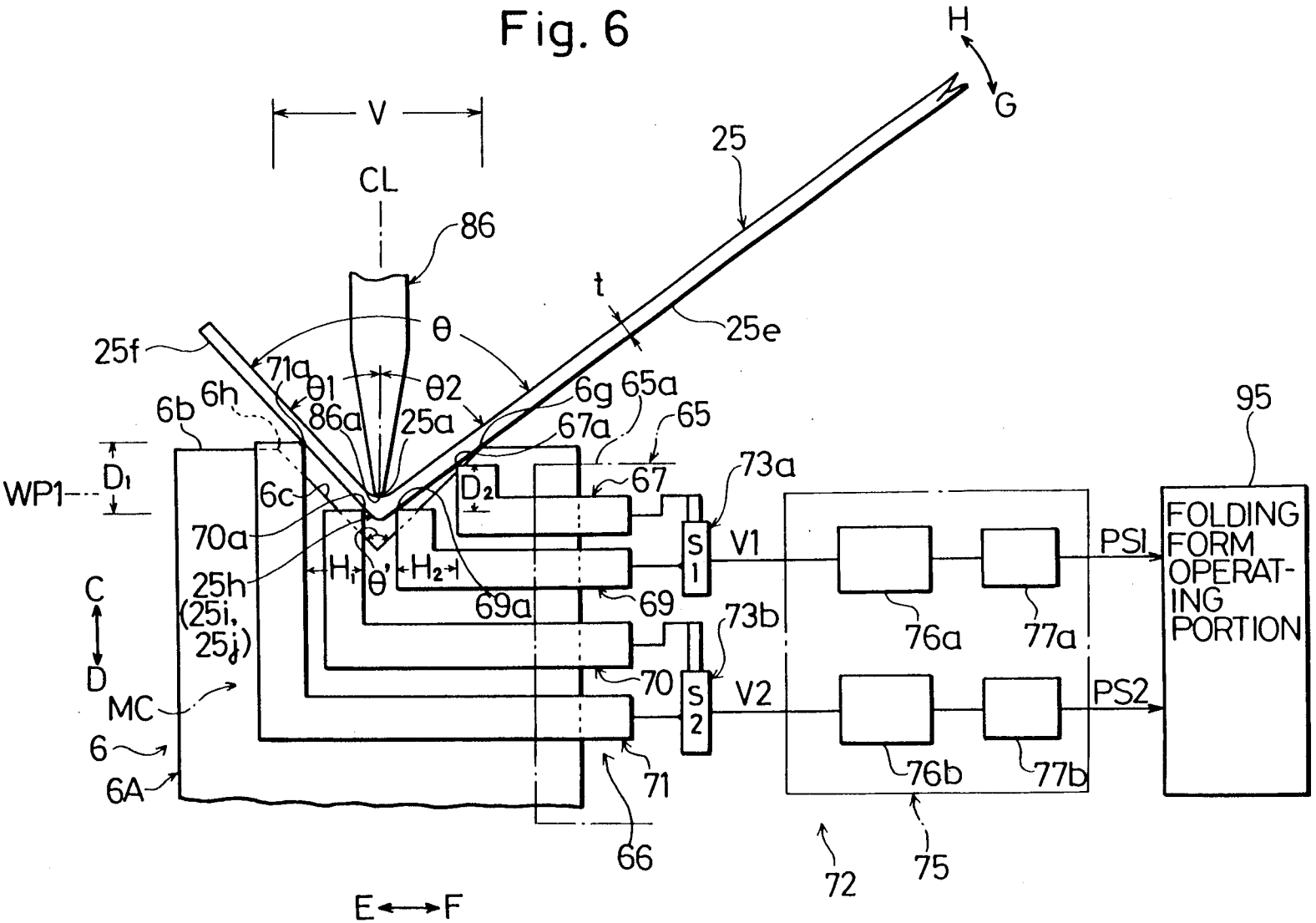
FIG. 6 is a schematic view showing the state after bending of a workpiece by a press brake as shown in FIG. 1, the bending angle of the workpiece being measured by using a bending angle measuring unit.

Each unit lower die 6A has a length of L1 in the directions shown by arrows A and B in FIG. 4. Measurement clearances MC are respectively formed between end faces 6*d* and 6*e* of the unit lower dies 6A, 6A adjacent to each other. Opposed notched portions 6*f*, 6*f* are respectively provided in end faces 6*d*, 6*e* in the shape of indentations in the unit lower die 6A with a depth of L3. A V cross-section groove 6*c* with a groove angle Θ' is formed in the upper face 6*b* of each unit lower die 6A as shown in FIG. 6.

A crowning unit 7 is provided in the lower mold portion 2 as shown in FIG. 2. The crowning unit 7 has a pressure receiving mechanism 9, and a pressure driving mechanism 11. The pressure receiving mechanism 9 comprises a pressure receiving body 9A, and a pressure block 12. The pressure receiving body 9A is formed by connecting a plurality of wedge members 10 (five members in the present embodiment) in the directions shown by arrows A and B in line on the lower side face 5*d* in the lower die supporting member 5. An engaging bevel face 10*a* is formed on the lower face of each wedge member 10 as shown in FIG. 2 and is inclined at a predetermined angle $\alpha$ to the directions shown by arrows A and B with the right end down in the figure. In such a structure, a pressure receiving face 9*b* is formed on the pressure receiving body 9A by the engaging bevel faces 10*a* of the respective wedge members 10.

A plurality of pressure blocks 12 (five blocks in the present embodiment) are provided on the bottom face 3*c* of the main body 3 of the lower mold portion 2 and are able to move in the directions shown by arrows A and B relative to the corresponding wedge members 10 as shown in FIG. 2. On the upper portion of each pressure block 12, an engaging bevel face 12*a* is formed which is inclined at a predetermined angle $\alpha$ to the directions shown by arrows A and B with the right end down in the figure. Each engaging bevel face 12*a* slidably abuts the engaging bevel face 10*a* of the corresponding wedge member 10.

A stepped hole 12*b* is formed in each pressure block 12 as shown in FIG. 2 in the directions shown by arrows A and B and aligned with each other. A clamp hole 17 is formed in each pressure block 12 perpendicular to the plane of the figure. A plurality of clamp holes 3*e* are provided in the side face 3*d* of the main body 3 of the lower mold portion 2 at predetermined intervals in the directions shown by arrows A and B corresponding to the above-described clamp holes 17. A solenoid 26 is provided on each pressure block 12 in alignment with the clamp hole 3*e*. A clamp pin 22 is provided on each solenoid 26 and is movable in directions into and out of the clamp hole 17 in perpendicular direction to the plane of the figure.

Figure 7:
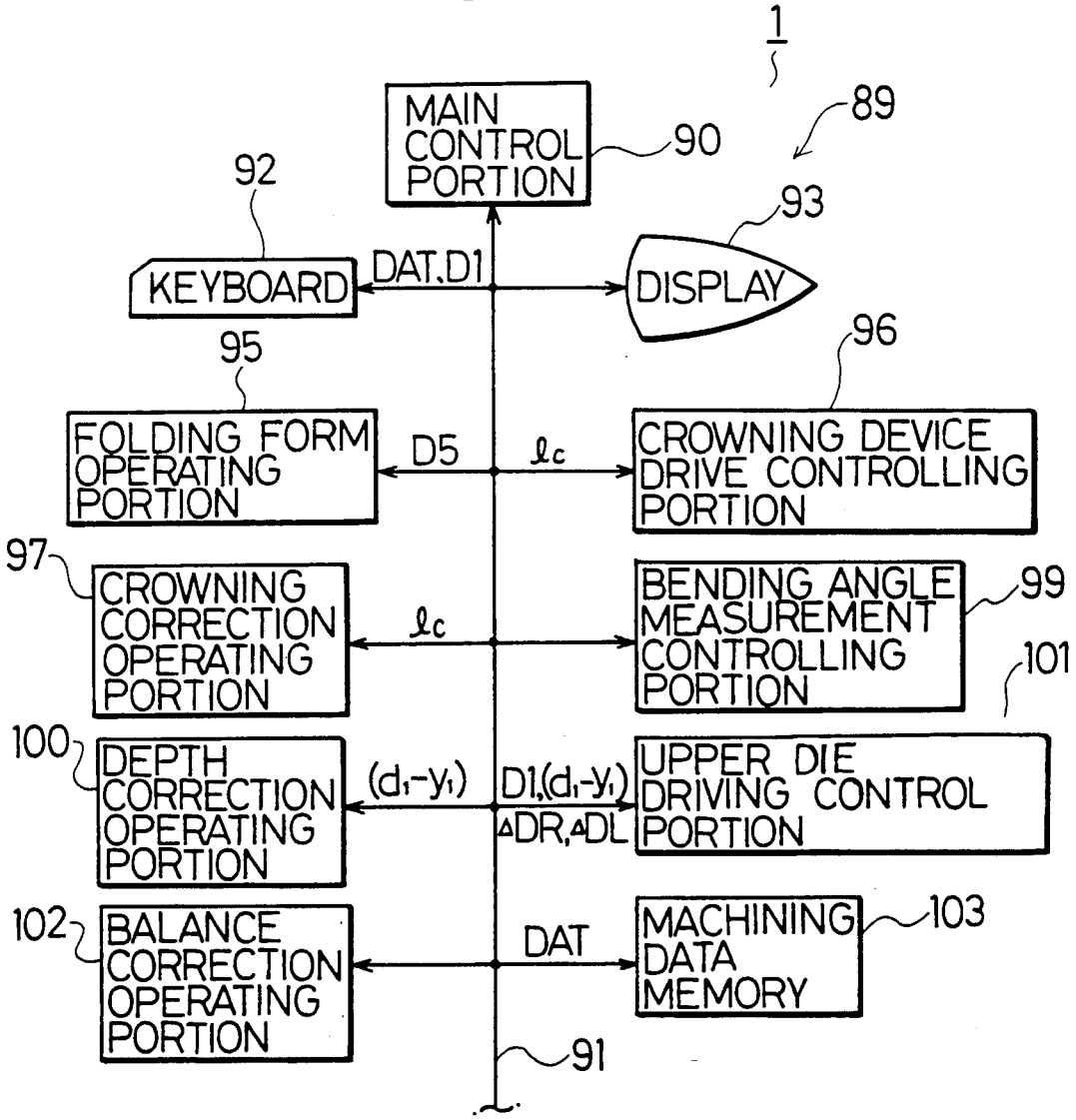
FIG. 7 is a diagram of an example of a numerical control unit of a press brake as shown in FIG. 1.

The pressure driving mechanism 11 is connected with the pressure block 12 as shown in FIG. 2. The pressure driving mechanism 11 has a pressure bar 13, and a driving motor 19. The pressure bar 13 is movably mounted in the lower mold portion 2 through the stepped hole 12*b* in each pressure block 12 in the directions shown by arrows A and B. On the pressure bar 13 are plural stoppers 15 formed at predetermined intervals in the directions shown by arrows A and B. A spring 16 is provided between each stopper 15 and the stepped hole 12*b* of each pressure block 12 surrounding the circumference of the pressure bar 13. The driving motor 19 is connected with the right end portion of the pressure bar 13 via a motion converter 20. A rotary encoder 19*a* is connected with the driving motor 19 and a crowning device drive controlling portion 96 described hereinafter as shown in FIG. 7 is connected to the driving motor 19 and the rotary encoder 19*a*.

A guide rail 60 is provided along the side face 3*j* of the main body 3 of the lower mold portion 2 extending in the directions shown by arrows A and B in FIG. 2. A pluralality of workpiece measuring units 61 (three units in the present embodiment) are movably mounted on the guide rail 60 in the directions shown by arrows A and B independent of each other. Each workpiece measuring unit 61 has a main body 62. An arm supporting portion 63 is movably and drivably provided on each main body 62 so as to be movable in directions shown by arrows C and D (in the up and down directions in the figure). An arm 65 is formed on the arm supporting portion 63 and extends in the directions shown by arrows E and F, to extend and retract as portion 63 moves. A probe portion 66 is provided on the top edge portion 65*a* of the arm 65 as shown in FIG. 6.

The probe portion 66 as shown in FIG. 6 has four probes 67, 69, 70, and 71, each having an L-form. The probe 67 is formed at the upper portion of the top edge portion 65*a* of the arm 65 and is free to move relative to the probe 69 (described hereinafter) in the directions shown by arrows C and D. A workpiece contacting portion 67*a* is provided on the top edge portion of the probe 67 protruding in the direction as shown by arrow C. The probe 69 paired with the probe 67 is movably provided below the probe 67 and is movable in the directions shown by arrows C and D. A workpiece contacting portion 69*a* protrudes from the top edge portion of the probe 69 in the direction shown by arrow C. The outer end of the workpiece contacting portion 69*a* extends beyond the workpiece contacting portion 67*a* of the probe 67 a predetermined distance $H_2$ in the direction shown by arrow E. Moreover, the probe 70 is movably and drivably provided below the probe 69 and is movable in the directions shown by arrows C and D relative to the probe 71 described later.

The workpiece contacting portion 70*a* protrudes from the top edge portion of the probe 70 in the direction shown by arrow C and protrudes past the workpiece contacting portion 69*a* of the probe 69 a predetermined distance in the direction shown by arrow E. Moreover, the probe 71 paired with the probe 70 is provided below the probe 70. The workpiece contacting portion 71*a* protrudes from the top edge portion of the probe 71 in the direction as shown by arrow C and protrudes past the workpiece contacting portion 70*a* of the probe 70 a set distance $H_1$ in the direction shown by arrow E. These probes 67, 69, 70 and 71 are urged by elastic means, such as a spring (not shown) in the direction shown by arrow C.

A probe displacement detecting portion 72 is connected with the probe portion 66 as shown in FIG. 6. The probe displacement detecting portion 72 has two differential transformers 73*a*, 73*b*, and a detecting control portion 75. The differential transformers 73*a*, 73*b* are respectively connected with the probes 67, 69 and the probes 70, 71 of the probe portion 66. Displacement instruments 76*a*, 76*b* forming part of the detecting control portion 75 are connected with the differential transformer 73*a*, 73*b* respectively. Pulse generators 77*a*, 77*b* forming part of the detecting control portion 75 are connected with the displacement instruments 76*a*, 76*a* respectively. The pulse generators 77*a*, 77*b* are connected with the folding form operating portion 95 (described later) as shown in FIG. 7.

An upper mold portion 81 is provided above the lower mold portion 2 as shown in FIG. 1. The upper mold portion 81 has an upper frame 1B, driving cylinders 82, 83, a ram 85, and an upper die 86. The two driving cylinders 82, 83 are provided on the upper frame 1B spaced a predetermined distance in the directions shown by arrows A and B. Rods 82*a*, 83*a* are movable in the driving cylinders 82, 83 in the directions shown by arrows C and D respectively. A motion quantity adjuster (not shown) is connected with the driving cylinders 82, 83 respectively and this adjuster adjusts the stroke of the rods 82*a*, 83*a* in the directions shown by arrows C and D. An upper die driving control portion 101 (described later) as shown in FIG. 7 is connected with the motion quantity adjuster. Moreover, the ram 85 is provided between the driving cylinders 82 and 83 and is supported by the rods 82*a*, 83*a* at the right and left end portions thereof. The upper die 86 is installed on the lower edge portion of the ram 85.

The press brake 1 has a numerical control unit 89 as shown in FIG. 7 and a main control portion 90. A keyboard 92, a display 93, a folding form operating portion 95, a crowning device drive controlling portion 96, a crowning correction operating portion 97, a bending angle measurement controlling portion 99, a depth correction operating portion 100, an upper die driving control portion 101, a balance correction operating portion 102, and a machining data memory 103 are connected with the main control portion 90 via a bus line 91.

Figure 5:
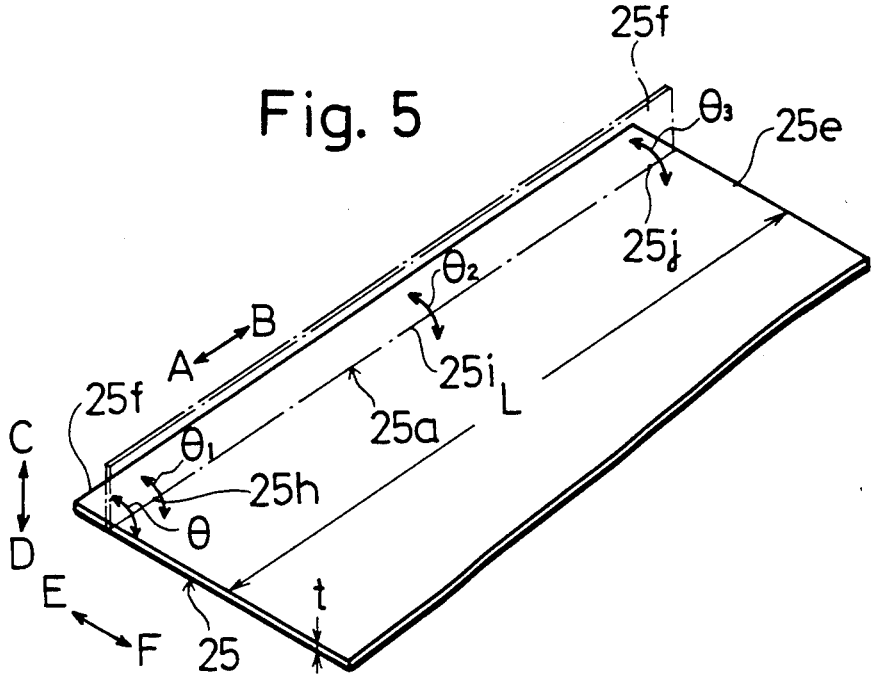
FIG. 5 is a perspective view showing an example of a workpiece which is machined by means of a press brake as shown in FIG. 1.

With the above-described constitution of the press brake 1, in order to bend a workpiece 25 having a thickness of t at a predetermined angle by using the press brake 1 as shown in FIG. 5, the workpiece 25 is inserted and supported between the lower die 6 and the upper die 86 and positioning the portion 25*a* to be bent on the lower die 6 as shown in FIG. 2. Thereafter, a worker stores machining data DAT, such as the material of the workpiece 25, the thickness t, the desired bending angle $\Theta_0$ and the width L of the plate in the machining data memory 103 via the keyboard 92 as shown in FIG. 7. Then the worker outputs machining starting command D1 to the main control portion 90 via the keyboard 92.

The main control portion 90 receives this command and orders the upper die driving control portion 101 as shown in FIG. 7 to lower the upper die 86 as shown in FIG. 1 a predetermined distance in the direction shown by arrow D. Receiving this command, the upper die driving control portion 101 causes the driving cylinders 82, 83 to synchronously operate via a motion quantity adjuster (not shown). The rods 82*a*, 83*a* are respectively extended a predetermined distance S1, S2 (=S1) in the direction shown by arrow D. The ram 85 is lowered together with the upper die 86 in the direction shown by arrow D from the position shown by the phantom lines in the figure by the rods 82*a*, 83*a* and the top edge portion 86*a* of the upper die 86 abuts the workpiece 25. Moreover, in this state, the upper die 86 is lowered in the direction shown by arrow D to press the workpiece 25 into the V-shape groove 6*c* of the lower die 6 with a predetermined pressure. As a result, the workpiece 25 is bent in a V-shape.

Figure 3:
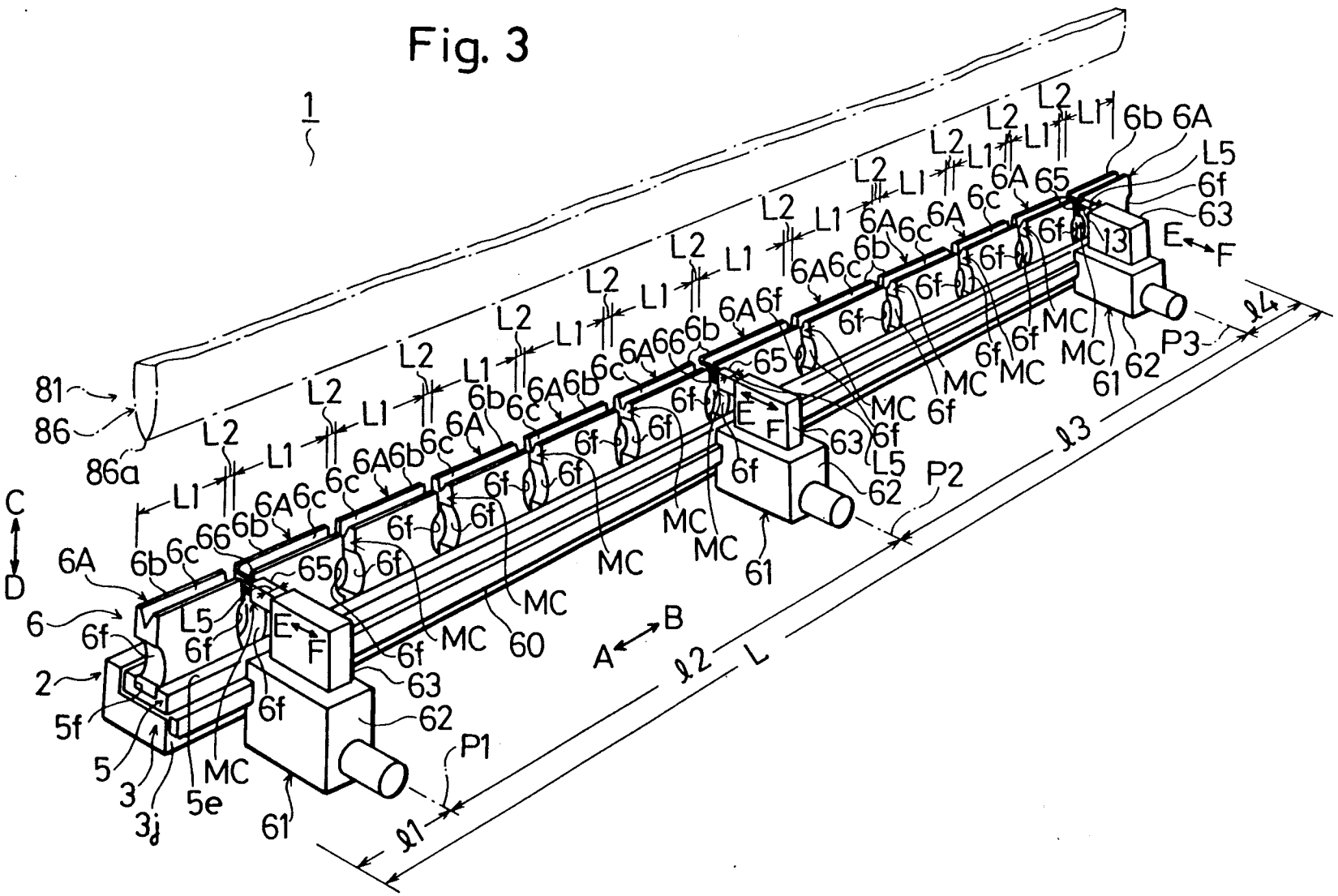
FIG. 3 is a perspective view showing the relation between the positions of the lower mold portion of a press brake as shown in FIG. 2 and a workpiece measuring unit.

In this way, after bending is performed on the workpiece 25, the angles $\Theta_1$, $\Theta_2$, $\Theta_3$ at the measuring positions 25*h*, 25*i*, 25*j* of the workpiece 25 as shown in FIG. 5 are measured by using the plural workpiece measuring units 61 as shown in FIG. 3 without ejecting the workpiece 25 from between the lower die 6 and the upper die 86. That is to say, after bending, the main control portion 90 as shown in FIG. 7 commands the upper die driving control portion 101 to position the upper die 86 as shown in FIG. 6 at a waiting position WP1 and to release the pressure relation between the workpiece 25 and the lower die 6. Then the upper die driving control portion 101 causes the driving cylinders 82, 83 as shown in FIG. 1 to retract the rods 82*a*, 83*a* a predetermined distance in the direction shown by arrow C respectively. Then the ram 85 rises a predetermined distance in the direction shown by arrow C together with the upper die 86 by being drawn by the rods 82*a*, 83*a* upwardly while the edge portion 86*a* of the upper die 86 still abuts the portion 25*a* of the workpiece 25 as shown in FIG. 6. The edge portion 86*a* of the upper die 86 is thus positioned at the waiting position WP1.

In this condition, the right side portion 25*e* of the bent portion 25*a* of the workpiece 25 is heavier than the left side portion 25*f*. Therefore, the workpiece 25 moves upwardly in the V-form groove 6*c* by rotating in the direction shown by arrow G for being supported by the edge portion 86*a* of the upper die 86 and the upper edge portion 6*g* on the right hand side of the V-form groove 6*c* and held there by the dead weight of the right side portion 25*e* acting in the direction shown by arrow G. Then the workpiece 25 rebounds. The bending angle $\Theta$ becomes larger than when the workpiece 25 is pressed into the V-form groove 6*c* of the lower die 6 by the upper die 86 (that is, the angle $\Theta'$ of the V-form groove 6*c*).

The main control portion 90 as shown in FIG. 7 commands the bending angle measurement controlling portion 99 to measure the bending angles $\Theta_1$, $\Theta_2$, $\Theta_3$ of the bent portions (that is, at the measuring positions 25*h*, 25*i*, 25*j*) of the workpiece 25 as shown in FIG. 5 corresponding to the workpiece measuring positions P1, P2, P3 as shown in FIG. 3. Receiving this command, the bending angle measurement controlling portion 99 causes each bending angle measuring unit 61 as shown in FIG. 3 to move the arm supporting portion 63 together with the arm 65 in the directions shown by arrows C and D. Moreover, each arm 65 is extended together with the probe portion 66 as shown in FIG. 6 in the direction shown by arrow E. Then the top edge portion 65*a* of each arm 65 and the probe portion 66 are inserted in the measurement clearance MC and the probe 66 is positioned below the bent workpiece at measuring positions 25*h*, 25*i*, 25*j*. At this time, each measurement clearance MC has a breadth of L4 (=L2+2.L3) enlarged from L2 by the notched portions 7, 7 as shown in FIG. 4. The breadth L4 is greater than the width L5 of the arm 65 in the directions shown by arrows A and B in FIG. 3. Accordingly, there is no possibility of collision between the arm 65 and the lower die 6.

Thereafter, the bending angle measurement controlling portion 99 as shown in FIG. 7 makes the arm supporting portion 63 of each bending angle measuring unit 61 as shown in FIG. 3 rise together with each arm 65 in the direction shown by arrow C. Then the probe portion 66 provided with the top edge portion 65*a* of each arm 65 as shown in FIG. 6 also rises in the direction shown by arrow C in FIG. 6. The workpiece contacting portions 67*a*, 69*a* of the probes 67, 69 abut the right side portion 25*e* of the workpiece at the measuring positions 25*h*, 25*i*, 25*j* of the workpiece 25 as shown in FIG. 6 respectively. Moreover, the right side portion 25*e* is pressed in the direction shown by arrow C with a predetermined pressure The workpiece contacting portions 70*a*, 71*a* of the probes 70, 71 respectively abut the left side portion 25*f* of the workpiece at measuring positions 25*h*, 25*i*, 25*j* of the workpiece 25 and the portion 25*f* is pressed in the direction shown by arrow C with a predetermined pressure.

At this time, the workpiece 25 is supported by the edge portion 86*a* of the upper die 86 and the upper flange portion 6*g* on the right side of the V-form groove 6*c* of the lower die 6 as shown in FIG. 6. Therefore, if the probe 67 of each workpiece measuring unit 61 pushes the workpiece 25 in the direction shown by arrow C, there is no possibility of workpiece 25 sliding down the lower die 6 by moving in the directions shown by arrows C and D.

In this way, when the probe portion 66 of each workpiece measuring unit 61 abuts the workpiece at the measuring positions 25*h*, 25*i*, 25*j* of the workpiece 25 as shown in FIG. 6 respectively, the bending angle measurement controlling portion 99 as shown in FIG. 7 causes the probe displacement detecting portion 72 to act as shown in FIG. 6. Then, the differential transformer 73*a* of each probe displacement detecting portion 72 outputs a voltage V1 corresponding to the relative displacement of the workpiece contacting portions 67*a*, 69*a* of the probes 67, 69 in the directions shown by arrows C and D to the displacement instrument 76*a* respectively. The differential transformer 73*b* of each probe displacement detecting portion 72 outputs the voltage V2 corresponding to the relative displacement of the probes 70, 71 in the directions shown by arrows C and D to the displacement instrument 76*b* respectively. Then the displacement instruments 76*a*, 76*b* respectively obtain the amount of displacement corresponding to the voltage V1, V2 (that is, the displacement corresponding to the distances $D_2$, $D_1$ as shown in FIG. 6) by operating. Furthermore, the displacement instruments 76*a*, 76*b* output the pulses PS1, PS2 corresponding to the obtained displacement to the folding form operating portion 95 as shown in FIG. 7 via the pulse generators 77*a*, 77*b* respectively. Receiving this, the folding form operating portion 95 obtains the bending angles $\Theta_1$, $\Theta_2$, $\Theta_3$ at the measurement positions 25*h*, 25*i*, 25*j* of the workpiece 25 as shown in FIG. 5 by the following equation (1).

$$\Theta=\Theta 1+\Theta 2=\arctan(H_1/D_1)+\arctan(H_2/D_2)+\epsilon \quad (1)$$

(Angles $\Theta 1$, $\Theta 2$ are the angles between the center CL of the lower die 6 and the left side portion 25*f* and the right side portion 25*e* of the workpiece 25 respectively, as shown in FIG. 6. $H_1$, $H_2$ are the set distances between the workpiece contacting portions 70*a* and 71*a* of the probes 70, 71 and between the workpiece contacting portions 67*a* and 69*a* of the probes 67, 69 in the directions shown by arrows E and F respectively. $\epsilon$ is a correction value.)

The bending angles $\Theta_1$, $\Theta_2$, $\Theta_3$ obtained in this way are outputted to the machining data memory 103 from the folding form operating portion 95 as shown in FIG. 7 to be stored in the memory 103. When the obtained bending angles $\Theta_1$, $\Theta_2$, $\Theta_3$ are different from the preset value $\Theta_0$ as described later, a correction operation is performed so that the angle $\Theta_1$ and the like can be made to correspond to the preset value $\Theta_0$.

Figure 8:
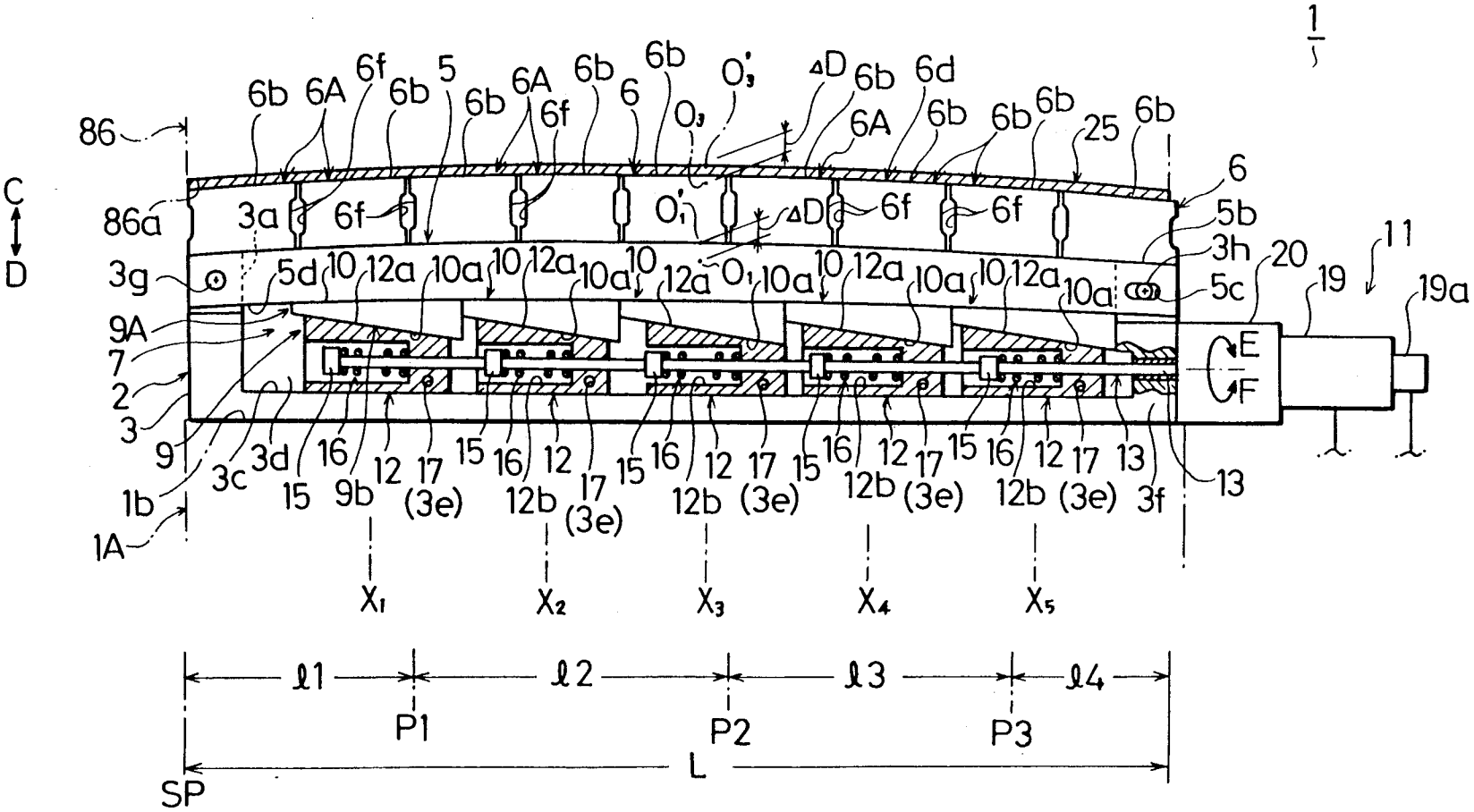
FIG. 8 is a sectional view showing a state in which bending is performed on a workpiece symmetrically protruding from a lower die by an upper die and using a crowning unit of a press brake as shown in FIG. 1.

For instance, when the thickness t of the workpiece 25 is large, the upper die 86 is warped by being curved upwardly at the time of pressurization toward the workpiece 25 by the pressure when the workpiece 25 is bent as shown in FIG. 8. Thus, in the measuring position 25*i* of the workpiece 25 as shown in FIG. 5, bending is less in comparison with the bending at the other measuring positions 25*h*, 25*j* since the upper die 86 cannot fully move toward the lower die 6. Therefore, the bending angle $\eta_2$ at the measuring position 25*i* of the workpiece 25 is larger than the bending angles $\Theta_1$, $\Theta_3$ at the other measuring positions 25*h*, 25*j*.

Figure 9:
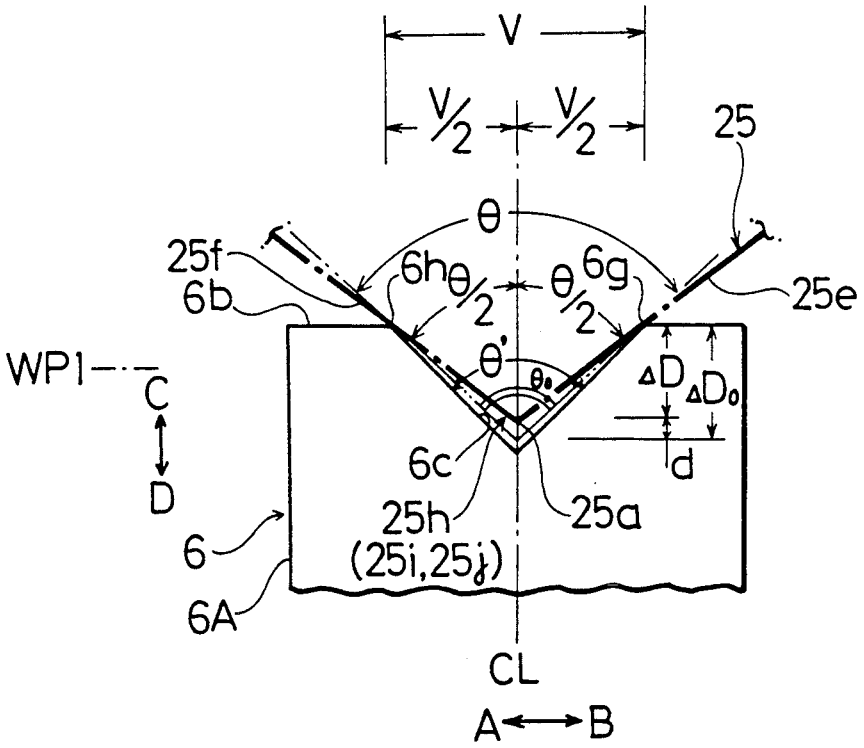
FIG. 9 is a diagram showing the depth chasing quantity of a workpiece after bending by a press brake as shown in FIG. 1.

Then the numerical control unit 89 as shown in FIG. 7 performs crowning, depth and right and left balance correction (described later) in order that all the bending angles $\Theta_1$, $\Theta_2$, $\Theta_3$ of the workpiece 25 will be equal to the preset value $\Theta_0$. That is, the main control portion 90 of the numerical control unit 89 outputs the depth quantity operating command D5 to the folding form operation portion 95 to obtain a depth quantity $\Delta D_1$, $\Delta D_2$, $\Delta_3$ at the measuring positions 25*h*, 25*i*, 25*j* of the workpiece 25 as shown in FIG. 9. The depth quantity $\Delta D$ is the distance between the upper face 6*b* of the lower die 6 and the bent portion 25*a* of the workpiece 25 in the directions shown by arrows C and D when the bent workpiece 25 is supported by the upper flange portions 6*h*, 6*g* of the lower die 6 when the bent portion 25*a* is at the center line CL of the lower die 6 as shown in FIG. 9.

The folding form operating portion 95 as shown in FIG. 7 receives the depth quantity operating command D5 to obtain the depth quantity $\Delta D_1$, $\Delta D_2$, $\Delta D_3$ on the basis of the positional relation between the V-form groove 6*c* of the lower die 6 as shown in FIG. 9 and the workpiece 25 as shown by the phantom line in the figure and the bending angles $\Theta_1$, $\Theta_2$, $\Theta_3$ described before by the following equation respectively.

$$\Delta D_1=(V/2)\cdot 1/\tan(\Theta_1/2) \quad (2)$$

$$\Delta D_2=(V/2)\cdot 1/\tan(\Theta_2/2) \quad (3)$$

$$\Delta D_3=(V/2)\cdot 1/\tan(\Theta_3/2) \quad (4)$$

(In this equation, the value V is the distance between the upper flange portions 6*g* and 6*h* of the V-form groove 6*c* of the lower die 6 in the directions shown by arrows A and B.)

Moreover, the folding form operating portion 95 as shown in FIG. 7 outputs the obtained $\Delta D_1$, $\Delta D_2$, $\Delta D_3$ to the crowning correction operating portion 97. Then the crowning correction operating portion 97 obtains a depth chasing quantity $d_1$, $d_2$, $d_3$ for each position by subtracting the depth quantity $\Delta D_0$ corresponding to the preset angle $\Theta_0$ of the workpiece 25 from the obtained depth quantity $\Delta D_1$, $\Delta D_2$, $\Delta D_3$ respectively.

$$d_1 = \Delta D_1 - \Delta D_0 = (V/2)\cdot\{1/\tan(\Theta_1/2) - 1/\tan(\Theta_0/2) \quad (5)$$

$$d_2 = \Delta D_2 - \Delta D_0 = (V/2)\cdot\{1/\tan(\Theta_1/2) - 1/\tan(\Theta_0/2) \quad (6)$$

$$d_3 = \Delta D_3 - \Delta D_0 = (V/2)\cdot 1/\tan(\Theta_1/2) - 1/\tan(\Theta_0/2) \quad (7)$$

Figure 11:
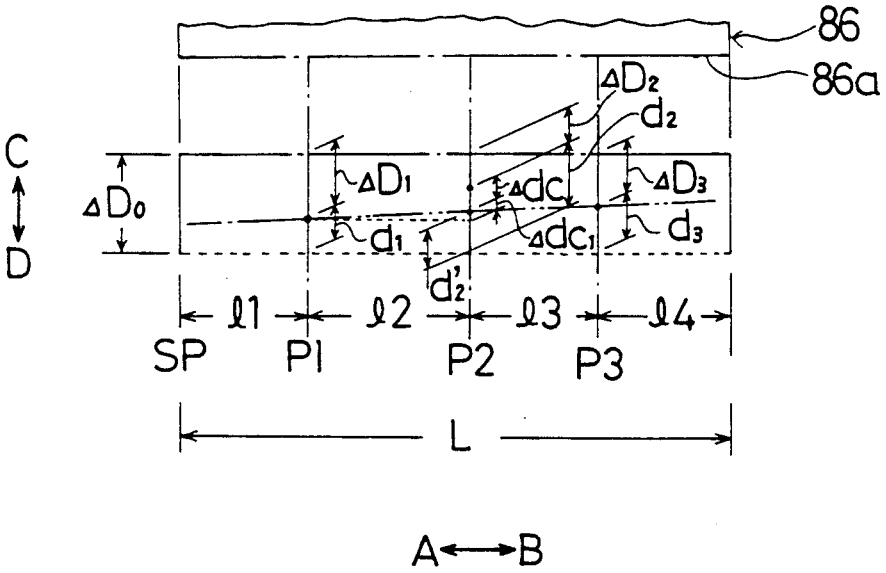
FIG. 11 is a diagram showing the depth chasing quantity of a workpiece in a predetermined measuring position, on which bending has been performed by means of a press brake as shown in FIG. 1.

After the depth chasing quantities $d_1$, $d_2$, $d_3$ are obtained in this way, a still further chasing quantity for the measuring position 2, that is, the quantity to be corrected for crowning correction, can be obtained because the value of the depth chasing quantity linearly changes from $d_1$ to $d_3$ from the standard point SP on the workpiece 25 in the direction shown by arrow B in FIG. 11. {The word "crowning" means to warp the lower die 6 by the upper die 86 in the shape of a crown.) Therefore, the main control portion 90 as shown in FIG. 7 commands the depth correction operating portion 100 to obtain the crowning correction quantity $\Delta dc$ as shown in FIG. 11. The term "crowning correction quantity $\Delta dc$" means the difference between the imaginary depth chasing quantity $d_2$, at the measuring position P2 when the depth chasing quantity d linearly changes between the measuring positions P1 and P3 of the workpiece 25 as shown in FIG. 11, and the depth chasing quantity $d_2$ at the measuring position P2 obtained in the folding form operating portion 95.

The following equation is obtained by using the depth chasing quantity $d_1$, $d_3$ at the measuring positions P1, P3 of the workpiece 25 as shown in FIG. 11, the imaginary depth chasing quantity $d_2$, at the measuring position P2, the distances from the standard position SP to the measuring positions P1, P2, P3, that is, $l_1$, $(l_1+l_2)$, $(l_1+l_2+l_3)$.

$$\begin{aligned}(d_3 - d_1):(l_2 + l_3) &= (d_2' - d_1):l_2 \\ &= \Delta dc_1:l_2 \\ \text{(on condition that } \Delta dc_1 &= (d_2' - d_1))\end{aligned}$$

By transforming this, the following equation is obtained.

$$\Delta dc_1=\{l_2\,(d_3-d_1)\}/(l_2-l_3)$$

Accordingly, the crowning correction quantity $\Delta dc$ is obtained by the following equation.

$$\begin{aligned}\Delta dc &= d_2 - \Delta dc_1 - d_1 \\ &= d_2 - \{l_2\cdot(d_3 - d_1)/(l_2 + l_3)\} - d_1\end{aligned}$$

Thereafter, the displacement y of the lower die 6 in the directions shown by arrows C and D which takes place in machining is respectively obtained at the measuring positions P1, P2, P3. That is, the displacement of each position is obtained by the following equation on the assumption that distributed load is w in the press operation, modulus of longitudinal elasticity is E, the geometrical moment of inertia of the lower die is I and the width of the workpiece is L.

$$y_1=\{w/(24\cdot E\cdot I)\}\cdot l_1\cdot(l_1^3-2\cdot L\cdot l_1^2+L^3)$$

$$y_2=\{w/(2\text{-}4\cdot E\cdot I)\}\cdot l_1+l_2)\cdot\{(l_1+l_2)^3-2\cdot L\cdot(l_1+l_2)^2+L^3\}$$

$$y_3=\{w/(24\cdot E\cdot I)\}\cdot(l_1+l_2+l_3)\cdot\{(l_1+l_2+l_3)^3-2\cdot L\cdot(l_1+l_2+l_3)^2+L^3\}$$

It is assumed that the displacement at the position P2 is $y_2$, and displacement linearly changes from $y_1$ to $y_3$ between the positions P1 and P3. Then the crowning quantity $\Delta yc$ corresponds with the crowning correction quantity $\Delta dc$ on the assumption that the deflection between the displacement $y_2$, and the displacement $y_2$ in the position P2 in fact is the crowning quantity $\Delta yc$. That is, in FIG. 10 the following equation is made.

$$\Delta yc=y_2-y_2'$$

and $$(y_2'-y_1):(y_3-y_1)=l_2:(l_2+l_3)$$
$$y_2'-y_1=\{l_2\cdot(y_3-y_1)\}/(l_2+l_3)$$
$$\therefore y_2'=\{l_2\cdot(y_3-y_1)\}/(l_2+l_3)+y_1$$

Consequently, the following equation is obtained.

$$\begin{aligned}\Delta yc &= y_2-y_2'\\ &= y_2-\{l_2\cdot(y_3-y_1)\}/(l_2+l_3)-y_1\end{aligned}$$

Then, the distributed load w is obtained by the above-described equation so that $\Delta dc$ can be equal to $\Delta yc$. The distributed load w is proportionate to the movement lc of the pressure block 12 in FIG. 2 of the crowning unit 2 in the directions shown by arrows A and B. Therefore, the movement $lc=K\cdot w$ (K is proportional constant) is selected to be a crowning correction value.

When the crowning correction value lc is obtained in this way, the main control portion 90 as shown in FIG. 7 outputs a crowning correction command to the crowning device drive controlling portion 96. Receiving this command, the crowning device drive controlling portion 96 causes the driving motor 19 as shown in FIG. 8 to rotate a predetermined amount in the direction shown by arrow F. Thus, the driving motor 19 draws the pressure bar 13 a distance corresponding to the amount of rotation of the driving motor 19 in the direction shown by arrow B via the motion converter 20. Then, the pressure bar 13 moves a distance corresponding to the crowning correction value (c in the stepped hole 12*b* of each pressure block 12 in the direction shown by arrow B compressing each spring 16 via the corresponding stopper 15. The amount of rotation of the driving motor 19 is measured by the rotary encoder 19*a* and the distance of movment of the pressure bar 13 is detected on the basis of the measured amount of rotation. Accordingly, it is possible to correctly move the pressure bar 13 the desired distance.

Figure 10:
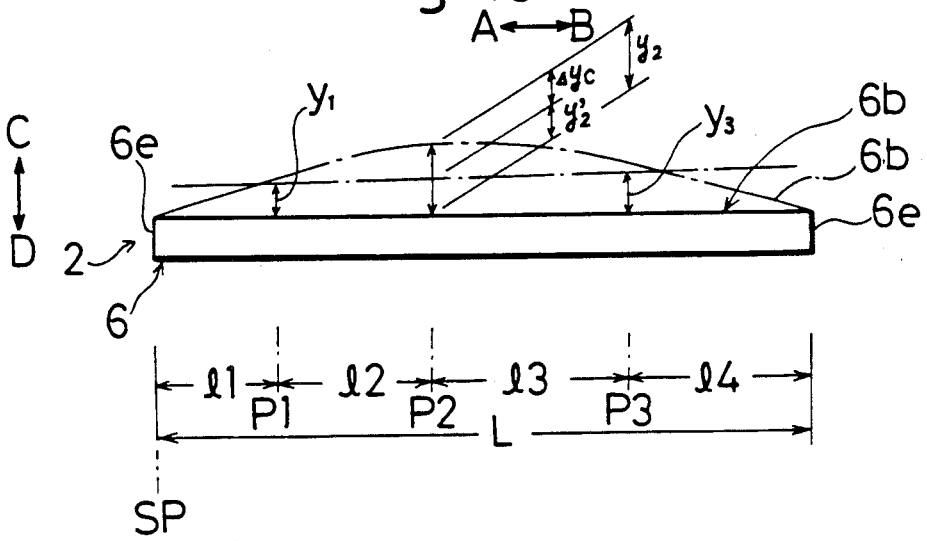
FIG. 10 is a diagram showing the amount of deflection of a lower die as shown in FIG. 8 in a predetermined measuring position.

When the pressure bar 13 moves a predetermined distance in the direction shown by arrow B in FIG. 8 comprising each spring 16 in this way, each pressure block 12 is pushed by the elasticity of the corresponding spring 16 in the direction shown by arrow B to move a predetermined distance in the direction shown by arrow B from the predetermined distance in the direction shown by arrow B from the predetermined positions $x_1$, $x_2$, $x_3$, $x_4$, $x_5$ while the engaging bevel face 12*a* is slidably engaged with the engaging bevel face 10*a* of the corresponding wedge member 10. Thereby, upward pressure acts on each wedge member 10 from the pressure block 12 via each engaging bevel face 10*a* since each engaging bevel face 10*a* is inclined downward to the right in the figure in the directions shown by arrows A and B. Then the lower die supporting member 5 is pushed upward via each wedge member 10 and is warped in the shape of an upwardly projecting curve as shown in FIG. 8. This makes the upper face 6*b* of the lower die 6 warp in the shape of an upwardly projecting curve as shown in FIG. 10 so as to be crowned.

When bending is performed on the workpiece 25 with the lower die 6 crowned, the workpiece bending depth is significantly changed by $\Delta dc$ at the measuring position P2 of the workpiece 25 due to the workpiece, as shown in FIG. 11. Thus, if the chasing quantity at the positions P1, P3 is correctly set, it is possible to bend the workpiece 25 properly. In order to do so, another depth correction is performed. At first, a correction operation is performed so that the depth at the position P1 will be $\Delta D_0$. That is, the necessary depth chasing quantity at the position P1 becomes $(d_1-y_1)$ according to the crowning of the lower die 6. Thereafter, the main control portion 90 as shown in FIG. 7 commands the depth correction operating portion 100 to perform the depth correction, taking the crowning of the lower die 6 into consideration. Then, the depth correction operating portion 100 obtains the depth correction value $(d_1-y_1)$, so that the depth at the measuring position P1 of the workpiece 25 can be a set value $\Delta D_0$ as shown in FIG. 11. This correction value is outputted to the upper die driving control portion 101. Receiving this, the upper die driving control portion 101 adjusts the stroke S1 of the rods 82*a*, 83*a* of the driving cylinders 82, 83 in the direction shown by arrow D in FIG. 1 so as to be longer by the depth correction value $(d_1-y_1)$ than before so that the depth in the position P1 can be a set value $\Delta D_0$ at the time of bending the workpiece 25. When bending is performed on the workpiece 25 when the depth correction has been performed in this way, the depth at the position P3 cannot be $\Delta D_0$ though the proper depth quantity $\Delta D_0$ is obtained at the position P1. At this time, the depth chasing quantity $\{(d_3-y_3)-(d_1-y_1)\}$ is still necessary at the measuring position P3 in order to obtain the proper depth $\Delta D_0$ at the position P3.

Figure 12:
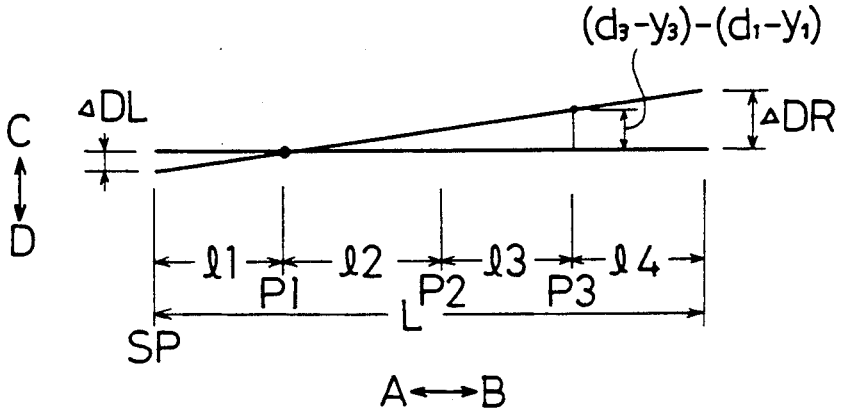
FIG. 12 is a diagram showing balance correction values for a workpiece in a predetermined measuring position, on which bending is performed by using a press brake as shown in FIG. 1.

Then, the main control portion 90 as shown in FIG. 7 commands the balance correction operating portion 102 to obtain a balance correction value for right and left so that the depth in the position P3 can be $\Delta D_0$. Receiving this command, the balance correction operating portion 102 adjusts the position of the upper die 86 so as to displace the workpiece 25 as shown in FIG. 1 by the depth chasing quantity $\{(d_3-y_3)-(d_1-y_1)\}$ in the direction shown by arrow D at the measuring position P3 at the time of bending. At this time, the following equation is established on the basis of the depth chasing quantity at the measuring positions P1, P3 after crowning and depth correction as shown in FIG. 12.

$$\Delta DR:(l_2+l_3+l_4)=[(d_3-y_3)-(d_1-y_1)]:(l_2+l_3)$$

Accordingly, $$\Delta DR=(l_2+l_3+l_4)\cdot\{(d_3-y_3)-(d_1-y_1)\}\cdot(l_2+l_3)$$

$$\Delta DL:l_1=\{(d_3-y_3)-(d_1-y_1)\}:(l_2+l_3)$$

Accordingly, $$\Delta DL=l_1\cdot\{(d_3-y_3)-(d_1-y_1)\}/(l_2+l_3)$$

At this time, $\Delta DL$ is the depth chasing quantity for the workpiece 25 at the standard position SP as shown in FIG. 1 and $\Delta DR$ is the depth chasing quantity at a position a distance L away from the standard position SP in the direction shown by arrow B.

The balance correction operating portion 102 as shown in FIG. 7 outputs the obtained ΔDR, ΔDL as a balance correction value for right and left to the upper die driving control portion 101. The upper die driving control portion 101 adjusts the strokes S1, S2 of the rods 82*a*, 83*a* of the driving cylinders 82, 83 in the direction shown by arrow D in FIG. 1 at the time of movement toward the workpiece 25 and the upper die 86 descends toward the lower die 6. Then the workpiece 25 is pressed in a manner such that the position of the upper die is changed to move the distance ΔDL in the direction shown by arrow D adding the above-described depth correction value $(d_1-y_1)$ at the standard position SP and the distance ΔDR in the direction shown by arrow C at the position a distance L in the direction shown by arrow B from the standard position SP.

In this way, bending is performed on the workpiece 25 so that the depth can be $\Delta D_0$ over the whole length by performing crowning, depth, and balance correction and adjustment is performed so that the bending angle Θ of the bent portion 25*a* can be the set value $\Theta_0$ over the full length of the workpiece.

In the above-described embodiment, the explanation is given of a case in which by providing the workpiece measuring units 61 on the lower mold portion 2 of the press brake 1 as shown in FIG. 3, the bending angle Θ of the workpiece 25 having V-form after bending is measured by means of the workpiece measuring unit 61 without ejecting the workpiece 25 from the press brake 1. However, the above-described workpiece measuring unit 61 is not the only one capable of being used with the press brake 1. Various kinds of workpiece measuring units are available. For instance, it is possible to provide a workpiece measuring unit 131 as shown in FIG. 14 with the press brake 1 for detecting the bending radius as shown in FIG. 13.

Such a case will be described hereinafter in which bending is performed on a workpiece 130 to bend it in the form of a circular arc by means of the press brake 1 having the workpiece measuring unit 61 for detecting bending radius and the bending radius R is measured by using the workpiece measuring unit 61 without ejecting the machined workpiece 130 from between the lower die 6 and the upper die 86 of the press brake 1. The same portions as those described in connection with FIGS. 3 and 4 are identified by the same numbers but the description thereafter has been omitted.

Figure 13:
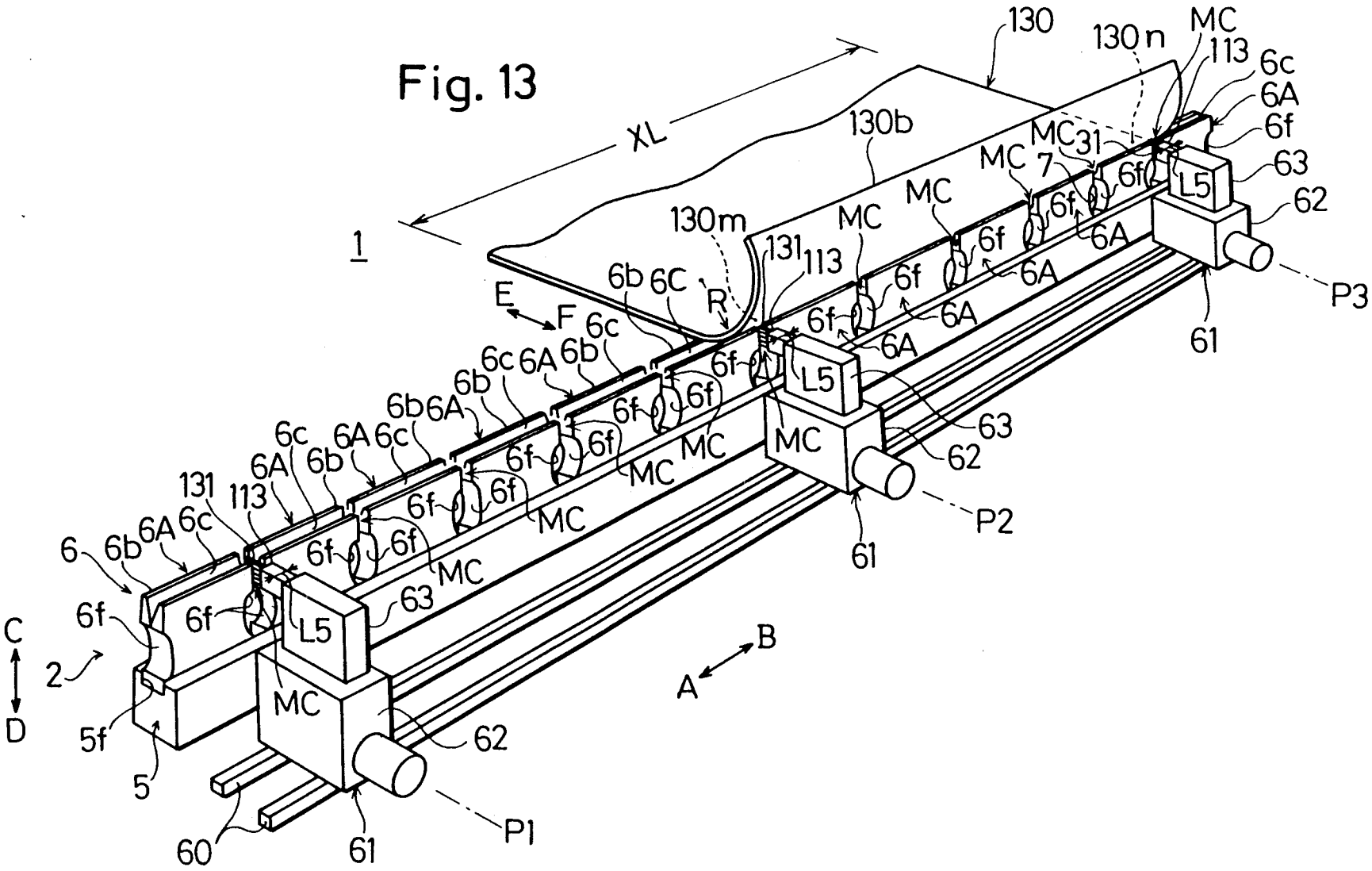
FIG. 13 is a perspective view of an important portion of another embodiment of a press brake according to this invention.
Figure 14:
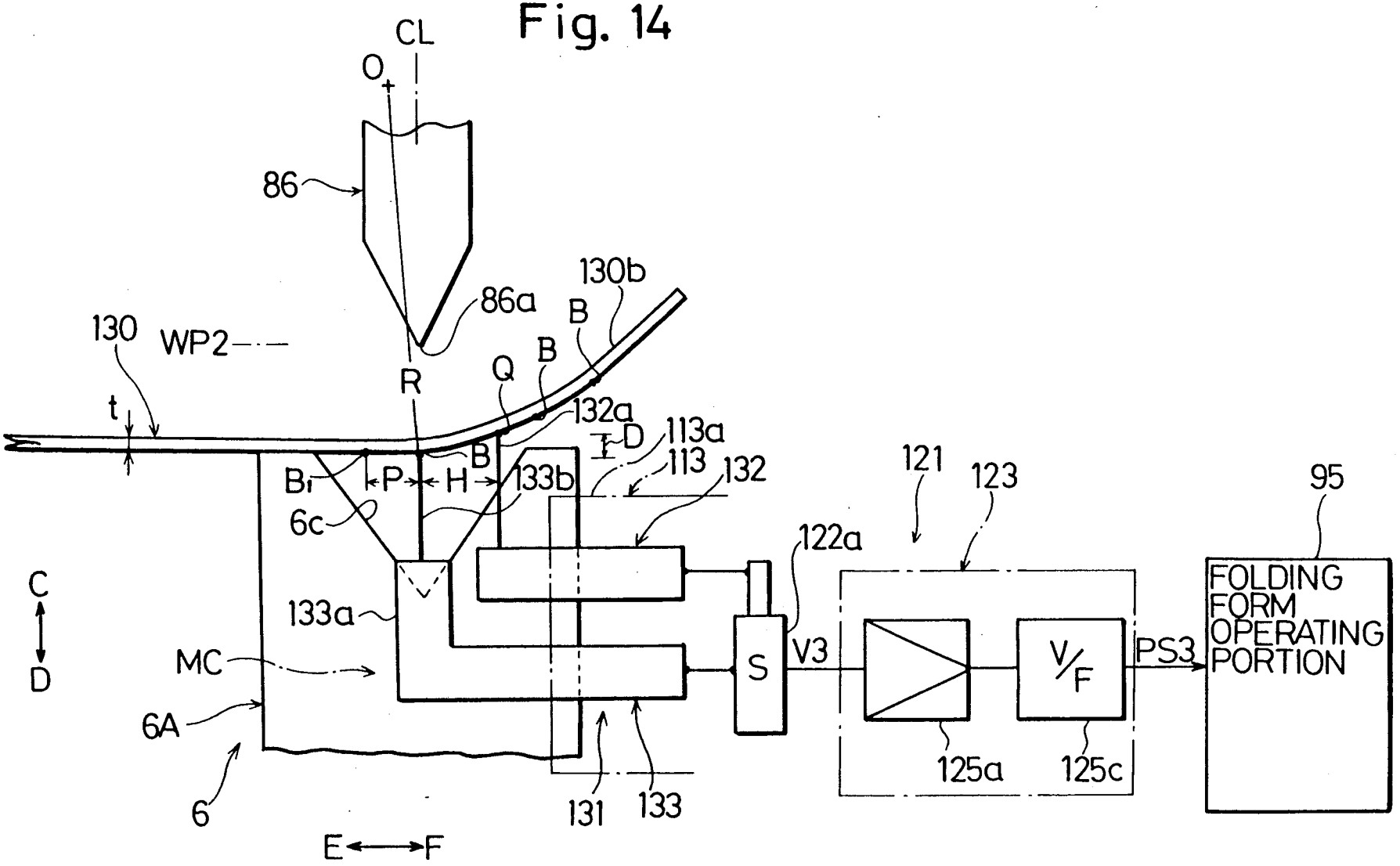
FIG. 14 is a diagram showing a state in which the bend radius of a workpiece bent in an arc shape is measured by using a workpiece measuring method in a press brake according to this invention.

Two parallel guide rails 60, 60 are provided at the right side of the lower die supporting member 5 of the press brake 1 and extending in the directions shown by arrows A and B in FIG. 13. On the guide rails 60, 60, plural workpiece measuring units 61 are movably and drivably mounted for movement in the directions shown by arrows A and B. At the top edge portion 113*a* of an arm 113 of the workpiece measuring unit 61, a probe portion 131 is provided as shown in detail in FIG. 14. A probe 132 having the form of a bar is movably mounted for movement in the directions shown by arrows C and D on the probe portion 131. At the top edge portion of the probe 132, a workpiece contacting pin 132*a* is provided extending in the direction shown by arrow C. A probe 133 having an L-shape is movably mounted on probe portion 131 for movement in the directions shown by arrows C and D and below the probe 132. At the top edge portion 133*a* of the probe 133, a workpiece contacting pin 133*b* is provided coinciding with the center of the V-shape groove 6*c* and being spaced a set distance H from the workpiece contacting pin 132*a* in the direction shown by arrow E, that is, on the movement center line CL of the upper die 86, and extends in the direction shown by arrow C.

In order to bend the workpiece 130 in the shape of a circular arc by means of the press brake 1 as shown in FIG. 13, at first the workpiece 130 is inserted between the lower die 6 and the upper die 86. The leading edge portion 130*b* of the workpiece 130 is positioned on the V-shape groove 6*c* of the lower die 6 as shown in FIG. 14. In this state, the upper die 86 is lowered a predetermined distance in the direction shown by arrow D along the movement center line CL. Then the edge portion 86*a* of the upper die 86 abuts the workpiece 130 and descends a predetermined distance in the direction shown by arrow D, exerting pressure on the workpiece 130. Then the workpiece 130 is bent at an obtuse angle with the edge 86*a* on the upper die 86 abutting the workpiece (it is referred to as "bent portion B" hereinafter) as its center.

After the workpiece 130 is bent at an obtuse angle with the bent portion B as its center, the upper die 86 is raised in the direction shown by arrow C to a waiting position WP2 spaced a predetermined distance above the workpiece 130. Thereafter, the workpiece 130 is moved a predetermined pitch P in the direction shown by arrow F. In this state, the upper die 86 is again lowered a predetermined distance along the movement center line CL in the direction shown by arrow D. Consequently, a new bent portion B of the workpiece 130 is bent at an obtuse angle. In this way, the workpiece 130 is bent in the approximate shape of a circular arc by obtusely bending the workpiece 130 every predetermined pitch as shown in FIG. 13 to form a series of bent portions B substantially forming a circular arc.

A measurement is performed as to whether the bending radius R of the workpiece 130 bent in the shape of a circular arc is a predetermined value. The bending radius R means the radius of a circle on the assumption that the workpiece 130 bent in the shape of a circular arc is a part of a circle. In order to measure the bending radius R of the workpiece 130, the upper die 86 as shown in FIG. 14 is first positioned at the waiting position WP2 by moving it a predetermined distance upward. The two workpiece measuring units 61, at the right of FIG. 13 are respectively moved along the guide rails 60, in the directions shown by arrows A and B to position them at the workpiece measuring positions P2, P3. Thereafter, the arm supporting portion 63 of each workpiece measuring unit 61 is properly moved and driven together with the corresponding arm 113 in the directions shown by arrows C and D respectively. Moreover, each arm 113 is caused to protrude together with the probe portion 131 as shown in FIG. 14 in the direction shown by arrow E. Then the top edge portion 113*a* of each arm 113 and the probe portion 131 are inserted in a corresponding measurment clearance MC. The probe portions 131 are positioned at the lower positions of the measuring positions 130*m*, 130*n* of the workpiece 130 as shown in FIG. 13.

Thereafter, in this state, the arm supporting portion 63 of each workpiece measuring unit 61 at the right of FIG. 13 is raised together with each arm 113 in the direction shown by arrow C. Then each probe portion 131 as shown in FIG. 14 also ascends in the direction shown by arrow C. The workpiece contacting pin 132*a* of each probe 132 abuts the previously bent portion of the workpiece 130. Moreover, the workpiece contacting pin 133*b* of the probe 133 constituting the probe portion 131 abuts the newly bent portion B of the workpiece 130.

In this way, when each probe portion 131 of the workpiece measuring units 61 abuts the workpiece at the measuring positions 130*m*, 130*n* of the workpiece 130, a probe displacement detecting portion 121 connected with each probe 131 is actuated, as shown in FIG. 14. A differential transformer 122*a* for each probe displacement detecting portion 121 outputs a voltage V3 corresponding to the relative displacement of the workpiece contacting pins 132*a*, 132*b* in the directions shown by arrows C and D to a displacement instrument 125*a* respectively. Then the displacement instrument 125*a* obtains the amount of displacement corresponding to the voltage V3 respectively (that is, the displacement corresponding to a distance D as shown in FIG. 14). The displacement instrument 125*a* outputs a pulse PS3 according to the obtained displacement to the folding form operating portion 95 via the pulse generator 125*c*. Then the folding form operation portion 95 obtains the bending radius R at the measuring positions 130*m*, 130*n* of the workpiece 130 as shown in FIG. 13 by the following equation (8).

$$R = \frac{1}{2D}\sqrt{(H^2 + D^2)\cdot\{(H + P)^2 + D^2\}} \simeq \epsilon \tag{8}$$

(In this equation, H is a set distance between the workpiece contacting pins 132*a* and 133*b* as shown in FIG. 14 in the directions shown by arrows E and F, D is the relative displacement of the workpiece contacting pins 132*a*, 133*b* as shown in FIG. 14 in the directions shown by arrows C and D, P is the feed pitch of workpiece 130 in the direction shown by arrow F, and $\epsilon$ is a correction value.)

Figure 15:
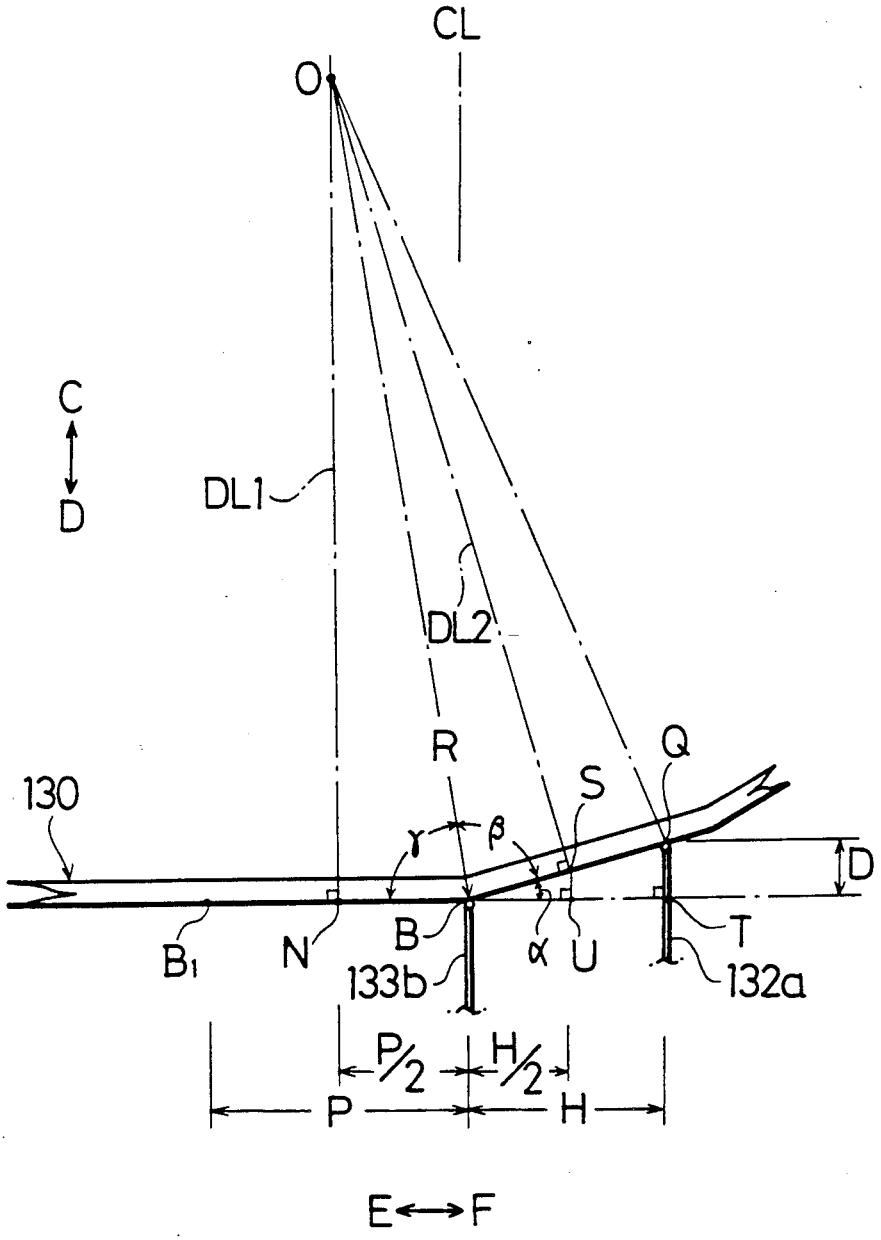
FIG. 15 is a diagram showing the relation between the position of a portion of a workpiece bent in an arc shape as shown in FIG. 14 and a workpiece contacting pin of a workpiece measuring unit.

Thereafter, the above-described equation (8) is developed on the basis of FIGS. 14 and 15. (FIG. 15 is obtained by simplifying FIG. 14. The lower die 6 and the upper die 86 are omitted in order to show the positional relation between the bent portion in the shape of a circular arc of the workpiece 130 and the workpiece contacting pins 132*a*, 133*b*.) That is, the portion of the workpiece 130 made up of portions B in the shape of a circular arc is approximately a part of a circle as shown in FIG. 14. The surface of each portion B of the workpiece 130 is perpendicular to the radius (that is, the bending radius R). A perpendicular DL1 is drawn from the middle point N of a straight line $B_1B_2$ corresponding to the bent portion B of the workpiece 130 on which the workpiece contacting pin 132*a* abuts. On the assumption that the intersection of the perpendiculars DL1 and DL2 is 0, the bending radius R is given by the following equation.

$$R = OB_2$$

Perpendiculars are drawn from the point Q and the middle point S to an extension of the straight line $B_1B_2$. It is assumed that the intersections are T, U respectively. On the assumption that $<QBT=\alpha$, $<OBQ=\beta$ and $<OBN=\gamma$, the following equation is obtained from FIG. 15

$$\alpha+\beta+\gamma=\pi$$

On the basis of the above-described equation, the following equation is obtained.

$$\cos(\alpha+\beta)=\cos(\pi-\gamma)$$

Accordingly, the equation (9) is obtained.

$$\cos\alpha\cdot\cos\beta-\sin\alpha\cdot\sin\beta=\cos\gamma \tag{9}$$

The length of the straight lines $B_2T$, QT is respectively H, D. Therefore, $$\begin{aligned}\cos\alpha &= B_2T/B_2Q = B_2T/\{(B_2T)^2 + (QT)^2\} \\ &= H/\sqrt{H^2 + D^2}\end{aligned} \tag{10}$$

$$\sin\alpha = QT/B_2Q = D/\sqrt{H^2 + D^2} \tag{11}$$

are obtained from the right-angled triangle $QB_2T$. The length of the straight lines $B_2U$, US is respectively given by the following equation of proportional relation in the right-angled triangle $QB_2T$.

$$BU=B_2T/2=H/2$$

$$SU=QT/2=D/2$$

Accordingly, by the right-angled triangle OBS $$\begin{aligned}\cos\beta &= B_2S/OB \\ &= \sqrt{(B_2U)^2 + (SU)^2}\ /R \\ &= \sqrt{(H/2)^2 + (D/2)^2}\ /R \\ &= \sqrt{H^2 + D^2}\ /(2\cdot R)\end{aligned} \tag{12}$$

are given. And, by the expression (12), $$\begin{aligned}\sin\beta &= \sqrt{1 - \cos^2\beta} \\ &= \sqrt{1 - \{(H^2 + D^2)/(4\cdot R^2)\}}\end{aligned} \tag{13}$$

are obtained. Moreover, by the right-angled triangle $OB_2N$ $$\begin{aligned}\cos\gamma &= BN/OB_2 = (P/2)/R \\ &= P/(2\cdot R)\end{aligned} \tag{14}$$

are given. The expressions (10)–(14) are put on (9). Then the following equation is obtained.

$$\{H/\sqrt{H^2 + D^2}\}\cdot\{\sqrt{H^2 + D^2}\ /(2\cdot R)\} - \{D/\sqrt{H^2 + D^2}\}\cdot\sqrt{1 - (H^2 + D^2)/(4\cdot R^2)} = -P/(2\cdot R)$$

Accordingly, by combining the above-described expressions, the following one is obtained.

$$(H + P)/(2\cdot R) = D\sqrt{1/(H^2 + D^2) - 1/(4\cdot R^2)}$$

Then, by squaring both sides of the above-described equation and combining them, the following equation is obtained.

$$\{(H+P)^2+D^2\}/(4.R^2)=D^2/(H^2+D^2)$$

Consequently, R is obtained by the following equation on the basis of the above-described equation.

$$R = \sqrt{(H^2 + D^2) \cdot \{(H + P)^2 + D^2\}/(4 \cdot D^2)} = \frac{1}{2D} \sqrt{(H^2 + D^2) \cdot \{(H + P)^2 + D^2\}} \quad (15)$$

However, the bent portion of the workpiece 130 is not a circular arc in a strict sense. Therefore, the expression (8) is obtained by adding a correction value $\epsilon$ to the right side of the expression (11) which was made on the assumption that the portion is a circular arc.

In the case where the measured bending radius R is different from a predetermined value, bending is again performed on the workpiece 130 to correct the bending radius R.

In the above-described embodiment, a description is given of a case where the measurement clearances MC are provided between the edge portions 6*d* and 6*e* of the unit dies 6A adjacent to each other as shown in FIG. 4. The location of the measurement clearance MC is not critical. If the bent form, such as bent angle Θ of the workpiece 130 inserted between the lower die 6 and the upper die 86 can be correctly measured, the clearance can be any place along the lower die 6 (for instance, the center portion of each unit lower die 6A).

The present invention is explained according to the examples hereinbefore. But the examples described in the present specification are not restricted by exemplary examples. The scope of the invention is according to the attached claims and not limited by the description of the examples. Accordingly, any changes within the scope of the claims is within the scope of the present invention.

We claim:

1. A press brake comprising:

a lower die disposed in a horizontal position and an upper die movable in up and down directions and out of and into workpiece shaping relationship with said lower die for bending a workpiece so that it has a bent portion;

at least one workpiece measuring portion provided on said lower die;

at least one workpiece measuring means at said workpiece measuring portion, said workpiece measuring means having at least two pairs of probes movable in up and down directions, said two pairs of probes being disposed on opposite sides of the bent portion of the workpiece which is in said lower die, a workpiece contacting portion on each of said probes for contacting said workpiece as said probes are moved upwardly in said lower die, and a displacement detectint means connected to said workpiece measuring means for detecting relative displacement in the up and down directions between said probes of each pair of probes as said probes respectively engage in the workpiece;

a folding form operation means connected to said displacement detecting means and including means for determining from the relative displacements of said probes the bend angles at which the parts of the workpiece on opposite sides of the bent portion are bent, and for determining from the bend angles a bending angle of said workpiece at which the workpiece has been bent;

a crowning correction operating means connected to said folding form operating means and having a depth chasing quantity obtaining means for obtaining from the bend angle of the workpiece and the dimensions of the lower die a depth chasing quantity at said workpiece measuring portion as the difference between the bent portion of the workpiece and the deepest portion of said die, and further having a crowning amount obtaining means for obtaining the amount of crowning of said lower die at said workpiece measuring portion;

a depth correction operating means connected to said crowning correction operation means for obtaining a depth correction value for said upper die from said depth chasing quantity; and a balance correction operating means connected to said depth correction operating means for obtaining a balance correction value for the opposite ends of said upper die from the depth correction value.

* * * * *